US011466353B2

(12) United States Patent
Pettersson et al.

(10) Patent No.: US 11,466,353 B2
(45) Date of Patent: Oct. 11, 2022

(54) HEAT TREATMENT OF A NICKEL BASE ALLOY AND COMPONENTS THEREOF

(71) Applicant: GKN Aerospace Sweden AB, Trollhättan (SE)

(72) Inventors: Bengt Pettersson, Trollhättan (SE); Johan Ockborn, Trollhättan (SE)

(73) Assignee: GKN Aerospace Sweden AB, Trollhättan (SE)

( * ) Notice: Subject to any disclaimer, the term of this patent is extended or adjusted under 35 U.S.C. 154(b) by 363 days.

(21) Appl. No.: 16/488,304

(22) PCT Filed: Feb. 28, 2018

(86) PCT No.: PCT/EP2018/054978
§ 371 (c)(1),
(2) Date: Aug. 23, 2019

(87) PCT Pub. No.: WO2018/158342
PCT Pub. Date: Sep. 7, 2018

(65) Prior Publication Data

US 2020/0032379 A1 Jan. 30, 2020

(30) Foreign Application Priority Data

Feb. 28, 2017 (GB) ..... 1703222

(51) Int. Cl.
*C22F 1/10* (2006.01)

(52) U.S. Cl.
CPC ..... *C22F 1/10* (2013.01)

(58) Field of Classification Search
CPC ..... C22F 1/10; C22C 1/023; C22C 1/0433; C22C 19/055; C22C 19/056;
(Continued)

(56) References Cited

U.S. PATENT DOCUMENTS 6,132,535 A 10/2000 Okada et al.
2003/0213536 A1* 11/2003 Cao ..... C22C 19/056 148/675
(Continued)

FOREIGN PATENT DOCUMENTS

DE 3427206 A1 2/1985
EP 2985424 A1 2/2016
(Continued)

OTHER PUBLICATIONS

Haynes (Haynes 282 Alloy, 2008, www.haynes.ch/doc/haynes/282_h3173.pdf). (Year: 2008).*
(Continued)

*Primary Examiner* — Christopher S Kessler
(74) *Attorney, Agent, or Firm* — Bejin Bieneman PLC

(57) ABSTRACT

Heat treatment of an Alloy 282 which has been subjected to an initial solution annealing followed by cooling can be heat treated by heating the Alloy 282 to a temperature between 954° C. and 1010° C. until the gamma prime (γ') phase is sufficiently dissolved, and cooling the Alloy 282 to a temperature a sufficiently low temperature, and at a sufficiently high cooling rate, to suppress gamma prime precipitation. A component such as a turbine exhaust case and a gas turbine engine made of said alloy can be heat treated in the above manner.

8 Claims, 3 Drawing Sheets

(58) Field of Classification Search
CPC ..... C21D 2211/004; C21D 9/50; B23K 1/19; B23K 2101/001; B23K 2103/08; B23P 15/006
See application file for complete search history.

(56) References Cited

U.S. PATENT DOCUMENTS

| | | | | |
|---|---|---|---|---|
| 2010/0239425 | A1* | 9/2010 | Miyashita | C22C 19/056 416/223 A |
| 2014/0140823 | A1* | 5/2014 | Krotzer, Jr | F01D 25/162 415/170.1 |
| 2015/0132110 | A1* | 5/2015 | Mountz | F01D 25/162 415/213.1 |
| 2015/0232974 | A1* | 8/2015 | Mannan | C22F 1/10 148/556 |
| 2016/0047255 | A1* | 2/2016 | Vargas | F02C 3/10 219/76.1 |
| 2018/0361478 | A1* | 12/2018 | Pardhi | B22F 3/24 |
| 2021/0189539 | A1* | 6/2021 | Arnett | C22F 1/10 |

FOREIGN PATENT DOCUMENTS

| | | | |
|---|---|---|---|
| JP | 2012092378 | A | 5/2012 |
| WO | 2013188722 | A1 | 12/2013 |

OTHER PUBLICATIONS

Equbal et al. ("Effect of Cooling Rate on the Microstructure and Mechanical Properties of Medium Carbon Steel", International Journal of Metallurgical Engineering 2016, 5(2): 21-24) (Year: 2016).*

Haynes, Haynes 282 Alloy, 2008, Haynes international, p. 1-28 (Year: 2008).*

Fahrmann, Simulation of gamma prime Precipitation Kinetics in a Commercial Ni-Base Superalloy, 2016,The Minerals, Metals & Materials Society, JOM, vol. 68, p. 2786-2792 (Year: 2016).*

Haynes 282 Alloy; May 31, 2008; pp. 1-28; XP055465497; Retrieved from the internet: URL: http://www.haynes.ch/doc/haynes/282_h3173.pdf [ retrieved on Apr. 9, 2018].

L.M. Pike; "Haynes 282(TM) Alloy: A New Wrought Superalloy Designed for Improved Creep Strength and Fabricability", Proceedings of GT2006, ASME Turbo Expo 2006; Power for Land, Sea and Air; May 8-11, 2006, Barcelona, Spain, vol. 4, May 8, 2006-May 11, 2006, pp. 1031-1039, XP055465039, US DOI: 10.1115/GT2006-91204; ISBN: 978-0-7918-4239-3.

International Search Report and Written Opinion for PCT/EP2018/054978 dated Apr. 24, 2018 (21 pages).

China National Intellectual Property Administration Notification of the Second Office Action dated Feb. 1, 2021 for Application No. CN201880013844.6 (15 pages; with English translation).

Fahrmann, M.G. et al.; The Journal of the Minerals, Metals & Materials Society, vol. 68, No. 11, 2016, MG Fahrmann, "Simulation of GAmma Prime Precipitation Kinetics in a Commercial Ni-Base Superalloy", pp. 2786-2792, first paragraph of "Experimental Details".

UKIPO Search Report for Application No. GB1703222.8 dated Jul. 23, 2018 (5 pages).

* cited by examiner

HEAT TREATMENT OF A NICKEL BASE ALLOY AND COMPONENTS THEREOF

CROSS-REFERENCE TO RELATED APPLICATIONS

This application is a national stage of, and claims priority to, Patent Cooperation Treaty Application No. PCT/EP2018/054978, filed on Feb. 28, 2018, which application claims priority to Great Britain Application No. GB 1703222.8, filed on Feb. 28, 2017, which applications each are hereby incorporated herein by reference in their entireties.

TECHNICAL FIELD

The present disclosure relates to a method for heat treatment of Alloy 282 which has been subjected to an initial solution annealing followed by cooling. Furthermore said alloy being heat treated according to the method and a component, a turbine exhaust case and a gas turbine engine made of said alloy are disclosed.

BACKGROUND

In applications such as aircraft jet engines, land based gas turbines, marine and automotive engines the present technical developments and demands regarding cost, fuel efficiency, engine performance and environmental aspects lead to the need of improving and further developing the materials used in different components used within the applications, e.g. the engine or turbine components. Especially, the recent developments have led to the turbine section of gas turbines being exposed to gases of higher temperatures, thereby putting special demands on the materials used in these sections. These parts therefore require high strength alloys which can withstand the extreme temperatures and harsh environments while still maintaining high strength and high durability required for these critical applications. Also, the weight of the components and the economic costs must be maintained within limits.

For the turbine section of an aircraft engine, especially the turbine exhaust case, different alloys can be used, depending on the temperature and strength requirements, while also factors such as weight and cost must be taken into account. As different parts of the turbine exhaust case are exposed to different temperature, an option might be to use different alloys in the different portions depending on temperature requirements, to thereby minimize weight and cost while meeting the requirements regarding heat resistance in the various portions. Also, by combining different materials in different parts of a component, the different requirements regarding strength and creep properties may be taken into account. However, a problem is that different alloys require different heat treatments in order to reach their optimum performance characteristics. Thus, a technological challenge is to join parts of different materials and subjecting them to a final heat treatment that meets both (or more) material individual requirements in terms of response to heat treatment and resulting properties.

Thus, there is a need for alloys with high strength for use at high temperature, which also allows fabricating components which meet other criteria regarding performance, durability, weight and cost. Especially the aircraft industry is subject to high standards regarding safety and environmental issues.

The present disclosure aims at, at least to a certain extent, alleviating the problems mentioned above.

SUMMARY

A method is presented for heat treatment of alloys, the method being aimed at solving the problems mentioned above.

In a first aspect, a method for heat treatment of an Alloy 282 is presented. According to this aspect an Alloy 282, after having been subjected to an initial solution annealing followed by cooling, is subjected to the method comprising the steps of:

a) heating the Alloy 282 at a temperature between 954° C. and 1010° C. until the gamma prime phase is sufficiently dissolved, and b) cooling the Alloy 282 to a sufficiently low temperature, and at a sufficiently high cooling rate, to suppress gamma prime precipitation.

These steps are referred to as solution treatment. By sufficiently dissolving the gamma prime phase (γ') required tensile strength and yield strength properties can be achieved for the heat treated alloy. A faster cooling will lead to increased strength of the alloy. With this method, the resulting mechanical strength properties are improved compared to the solution treatment used in the heat treatment method conventionally applied to Alloy 282.

According to one embodiment, in step b) the Alloy 282 is cooled to a temperature below 594° C.

According to one embodiment the heating in step a) takes place during 0.5 to 2 hours.

According to one embodiment, the cooling in step b) is performed at a rate equal to or higher than 19° C./min.

According to one embodiment the cooling in step b) is performed at a rate of 19-25° C./min.

According to one embodiment the heating as defined by step a) is performed at 954° C.

According to one embodiment the heating as defined by step a) is performed at 996° C. This further improves the mechanical properties of the Alloy 282.

According to one embodiment the method further comprises the steps of: c) heating the Alloy 282 at 760° C. for 5 hours followed by cooling to 650° C., and d) holding the alloy at 650° C. for 1 hour.

These steps are referred to as age-hardening. This part of the heat treatment method is particularly important for the resulting strength of the alloy.

According to one embodiment the cooling from 760° C. to 650° C. is performed at an average rate of 56° C.±8° C. per hour.

According to one embodiment, the Alloy 282 is joined together with an Alloy 718 prior to the heat treatment, whereby the combined unit is subject to the heat treatment.

According to one embodiment, the Alloy 282 and the Alloy 718 have been joined together by welding or by free-forming methods.

According to one embodiment, the Alloy 282 is joined together with an Alloy 718 by brazing during the heat treatment.

According to one embodiment, the Alloy 282 or the Alloy 718 or both have been formed into a shape by any of the methods wrought, cast, spray formed, powder metallurgy methods or free-forming methods. This gives the possibility of forming an alloy or combinations of alloys into a wide range of different shapes.

According to a second aspect an Alloy 282 which has been heat treated by the method for heat treatment according to the first aspect described. The Alloy 282 which has been heat treated with this method has improved strength characteristics compared to an Alloy 282 which has been heat treated according to a method conventionally used for Alloy 282.

According to a third aspect a component comprising an Alloy 282 according to the second aspect is described. Such a component benefits from the improved mechanical properties of the alloy.

According to one embodiment, the Alloy 282 is combined with an Alloy 718 prior to heat treatment according to the first aspect. This has the advantage that the multi-alloy component is subjected to a common heat treatment. As described in detail below, this heat treatment method is developed to result in optimized mechanical properties for both Alloy 282 and Alloy 718. The assembled component can therefore with good results be subjected to the common heat treatment.

According to one embodiment the Alloy 282 and the Alloy 718 have been joined together by welding or by free-forming methods.

According to one embodiment, the Alloy 282 is combined with an Alloy 718 by brazing during the heat treatment.

According to one embodiment of the third aspect the Alloy 282 and the Alloy 718 have been formed into shape by any of the methods wrought, cast, spray formed, powder metallurgy methods or free-forming methods. This gives the possibility of forming an alloy or combinations of alloys into a wide range of different shapes.

According to a fourth aspect a turbine exhaust case comprising a component according to the third aspect is described. This turbine exhaust case benefits from the improved mechanical strength properties resulting from the heat treatment method of the first aspect. Especially, by forming some portions of the turbine exhaust case from Alloy 282 and other portions from Alloy 718, as described in detail below, a turbine exhaust case which can withstand the very high temperatures of the exhaust gases which results from recent engine developments is achieved. By combining the different alloys, costs and weight of the turbine exhaust case can be maintained within limits while still achieving a turbine exhaust case having the required temperature characteristics and mechanical strength properties.

According to a fifth aspect a gas turbine engine comprising a turbine exhaust case according to the fourth aspect is described.

A heat treatment is described, where alloys of different character are selected that can be joined without difficulties like weld cracking (or post weld heat treatment) and where they can be given the same (hybrid) treatment with little or no reduction of the properties the alloys exhibit when used individually and heat treated according to their individual optimized heat treatment cycles.

Further, according to the method disclosed, fabricated components, comprising different alloys can be salvaged and repaired both during manufacture and in service.

A specific method for heat treatment applied to a nickel base alloy of the type 282 Alloy is presented. Such an alloy is for example known under the trade name Haynes 282. Alloy 282 is a material suitable for aircraft engines and gas turbines due to its high heat resistance. By using the disclosed heat treatment, the strength and ductility of an Alloy 282 can be increased compared to what has been reported when this alloy have been given other heat treatments, such as the heat treatment conventionally used for Alloy 282.

The method presented below can also be used for components comprising several different alloys joined together, where the different alloys are subjected to the heat treatment after being joined together.

In particular, the heat treatment described herein is developed for components and products which are formed by combinations of different alloys, such as Alloy 282 and Alloy 718, which have been joined together e.g. by welding. The heat treatment method is developed to balance the respective heat treatment requirements of the different alloys: During the solution annealing phase (steps a) and b)), the temperature should be set as high as possible for Alloy 718, which is the more heat sensitive material, while still maintaining its required strength properties, and at the same time achieving the optimum properties for Alloy 282, which requires higher temperatures for proper solution annealing. During the age hardening phase (steps c) and d)) the temperature must be set low enough that the required strength is achieved for both alloys. Alloy 718 cannot withstand the age hardening process conventionally applied to Alloy 282, but at the same time, an age hardening process must be provided which results in the required strength properties also for Alloy 282. Surprisingly, the method as described in detail below results in an Alloy 282 with improved strength properties compared to an Alloy 282 subjected to the heat treatment method conventionally applied to Alloy 282.

BRIEF DESCRIPTION OF THE DRAWINGS

The present disclosure will hereinafter be further explained by means of non-limiting examples with reference to the appended figures where.

DETAILED DESCRIPTION

Figure 1:
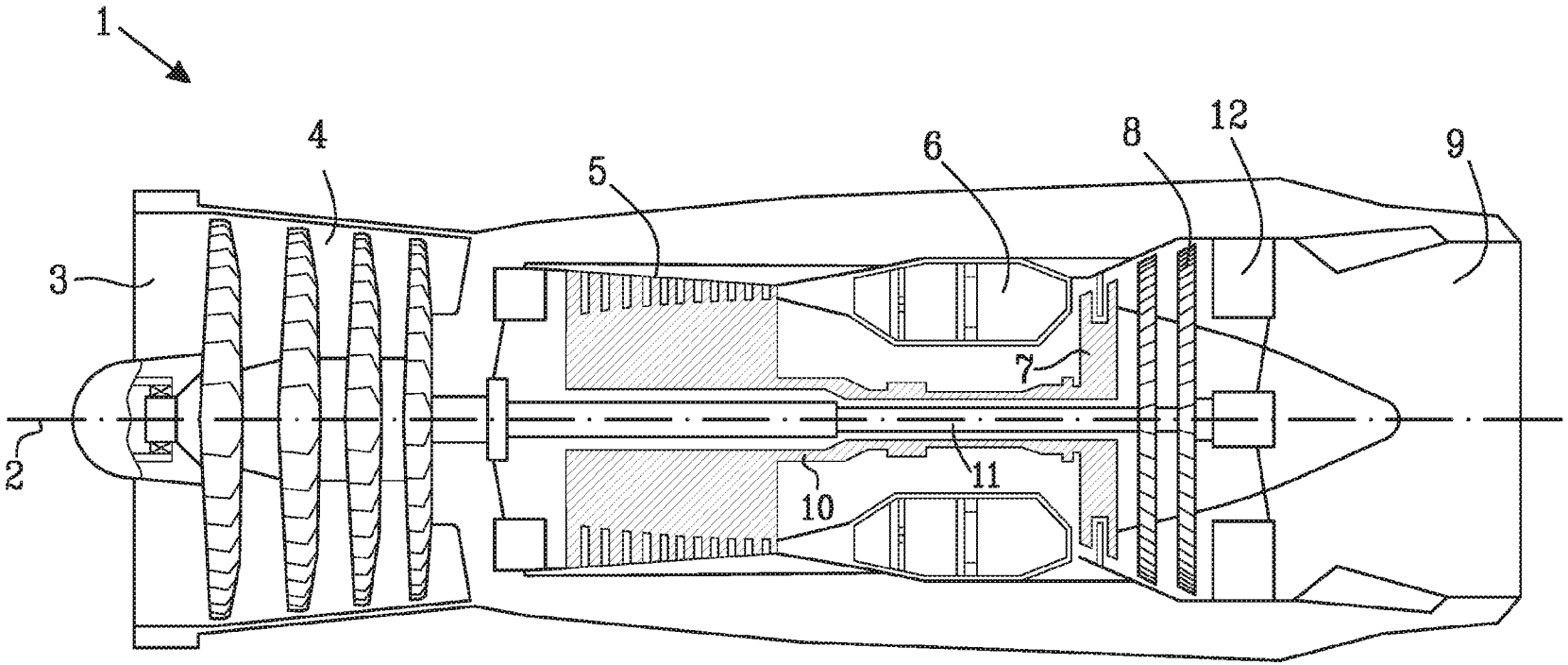
FIG. 1 schematically shows an aircraft engine in cross section.

An aircraft engine is shown schematically in FIG. 1. The main parts of the aircraft engine 1 are a fan section 4, a compression section 5, a combustion section 6, and a turbine section 7, 8, arranged in this order along an axis 2. The compression section 5 further comprises a low pressure compressor followed by a high pressure compressor, which compress at least a part of the air entering the engine through the inlet 3 before it is made to enter the combustion section 6. A part of the air entering via the inlet may be led through a by-pass flow path (not shown) such as to generate forward thrust. In the combustion section 6 the combustion takes place, by ignition and burning of a mixture of air and fuel. The combustion products are made to expand through the turbine section, thereby making the turbines rotate around the axis 2. A high pressure turbine 7 and the high pressure compressor are mounted on a common shaft 10, such that the high pressure turbine drives the rotation of the high pressure compressor. The high pressure turbine 7 is followed by a low pressure turbine 8, which is mounted on a shaft 11 common with the low pressure compressor and the fan 4, such that the low pressure turbine 8 makes the fan 4 and the low pressure compressor rotate. Both shafts are concentric and rotate around the engine central axis 2.

At the end of the turbine section a turbine exhaust case (TEC) 12 is mounted. A turbine exhaust case is shown schematically in FIG. 2. It comprises inner hub portions 15, 16 which are connected to an outer hub 13 via vanes (air foils) 14. The function of the turbine exhaust case is to provide a mechanical support to the engine via its outer hub, and forms part of the outlet of the hot exhaust gases which thereby pass through the turbine exhaust case, eventually mixed with air that has eventually been led through the by-pass flow path. As mentioned above different parts of the turbine exhaust case are exposed to different temperatures, generally the vanes 14 and the outer hub 13 being exposed to the hottest gases. The method presented below is particularly suited during manufacture of turbine exhaust cases.

While alloys of the type Alloy 718 have been conventionally used in turbine exhaust cases, the increase in temperature to which the turbine exhaust case is exposed as a result of engine developments leads to a need for use of other materials, since Alloy 718 is not suitable for these high temperatures due to a thermal instability occurring at higher temperatures. The development of the strength properties with time under exposure to these high temperatures would lead to unpredictable changes in strength of the Alloy 718. An Alloy 282 has higher heat resistance, i.e., it is thermally stable at these high temperatures, and could therefore be a suitable candidate for use in high temperature aircraft engine applications, such as turbine exhaust cases. However, Alloy 282 is not as strong as Alloy 718, especially not at somewhat less high temperatures. Therefore, if completely replacing the Alloy 718 components in a turbine exhaust case with Alloy 282 components, the dimensions, especially the thicknesses, of the components would need to be increased in order to reach the specified strength requirements. This would lead to an increase in weight and price of the turbine exhaust case. Alloys 718 and 282 will be discussed in more detail below.

One way to come around this problem, is to form only the parts of the turbine exhaust case that are exposed to temperatures in excess of what the Alloy 718 alloy can withstand from Alloy 282, while the other parts are made of Alloy 718. For example, the inner hub and portions of the outer case might comprise Alloy 718, while the vanes and the portions of the outer case to which the vanes are connected might comprise Alloy 282. The outer part of the turbine exhaust case is thereby made of an alloy adapted to withstand the highest temperatures, whereas for the inner part, which does not need to withstand as high temperatures, Alloy 718 can be used since it has the properties required for the inner parts. By using different alloys for different parts of a component, in the present embodiment Alloy 282 for certain portions and Alloy 718 for other portions of the turbine exhaust case, the different criteria regarding temperature requirements can be met, while at the same time meeting criteria related to engine performance and durability, and economics in cost and weight.

However, a challenge lies in the fact that different alloys need to be subjected to different heat treatment in order to reach their optimum performance. This is also the case for the alloys Alloy 282 and Alloy 718, where the known and conventionally applied heat treatment method for Alloy 282 differs from the known and conventionally applied heat treatment method for Alloy 718.

A description of what is meant with Alloy 282 and Alloy 718 will now follow. To begin with, Alloy 282 is defined in U.S. Pat. No. 8,066,938 B2. An example of such an alloy is known under the trademark Haynes 282, defined by AMS standard 5951, where the chemical compositions are given in Table 1 of the AMS standard 5951. Haynes 282 is a nickel base alloy, having the following nominal chemical composition (weight percent, w-%): Ni (57 w-%), Cr (20 w-%), Co (10 w-%), Mo (8.5 w-%), Ti (2.1 w-%), Al (1.5 w-%), Fe (1.5 w-%), Mn (0.3 w-%), Si (0.15 w-%), C (0.06 w-%), B (0.005 w-%). In the present disclosure, although Haynes 282 is advantageously used, the term "Alloy 282" is to be interpreted as any alloy having these specifications. The Haynes 282 alloy was developed for high temperature applications, such as aircraft engines and land-based gas turbines. For the Alloy 282 good strength properties have been shown for temperatures up to 927° C. (1700° F.).

After an initial solution-annealing which for Alloy 282 typically takes place at a temperature in the range of 1121 to 1149° C. (2050 to 2150° F.) followed by cooling, e.g., rapid cooling or quenching, the Alloy 282 is formable into components and products. The initial solution-annealing could also be performed at lower temperatures. This initial solution-annealing usually takes place by heating at a temperature of 1121-1149° C. for approximately 1 hour, followed by rapid cooling or quenching. The piece of alloy is put into a furnace which is already at the desired temperature, and the temperature throughout the alloy material is allowed to equalize at this temperature. After reaching the desired temperature, it is held at that temperature for the set time, usually 1 hour. A length time that it takes for the material to reach that temperature throughout its structure depends on its dimensions. With "rapid cooling" it is understood here that the cooling rate should be fast enough to result in clean grain boundaries and grain interiors free of secondary precipitations, i.e., that little, if any, gamma prime (γ') phase is present after solution-annealing. In practice, the material is cooled as fast as possible, for example by cooling in a bath such as an oil bath. After this initial solution-annealing the alloy is soft and ductile and can be formed into a desired shape.

The particular example of Haynes 282 alloy is delivered in the solution-annealed condition. After component fabrication, the alloy can be subject to a heat treatment including a gamma prime solution treatment (also acting as a "carbide stabilization treatment") followed by age hardening, in order to put the alloy into its high-strength condition. The known and conventionally applied age hardening treatment for Haynes 282 is to heat at 1010° C. (1850° F.) for 2 hours, followed by air cooling or rapid cooling and subsequently heating at 788° C. (1450° F.) for 8 hours, again followed by air cooling.

Secondly, the Alloy 718, which also is a nickel base alloy, is known under trade names such as INCONEL 718 and Allvac 718. INCONEL 718 has the following nominal chemical composition (weight percent, w-%): Ni (plus Co) (50-55, w-%), Cr (17-21, w-%), Fe (balance), Nb (plus Ta) (4.75-5.50, w-%), Mo (2.80-3.30, w-%), Ti (0.65-1.15, w-%), Al (0.20-0.80, w-%), Co (max 1.00, w-%), C (max 0.08, w-%), Mn (max 0.35, w-%), Si (max 0.35, w-%), P (max 0.015, w-%), S (max 0.015, w-%), B (max 0.006, w-%), Cu (max 0.30, w-%). Alloy 718 is defined by standards AMS 5662 (bar/forgings), AMS 5596, and AMS 5383 (castings) (see Table 1 of the respective standards for the chemical composition), and has been described in, e.g., U.S. Pat. No. 3,046,108. In the present disclosure, the term "Alloy 718" is to be interpreted as any alloy complying with these specifications. Alloy 718 has conventionally been used for various components, e.g., in aircraft engines and other gas turbines. However, as discussed above, Alloy 718 does not possess the temperature characteristics required by recent developments in engine applications, that is, an alloy 718 cannot withstand long-term exposure to the high temperatures to which certain parts of aircraft engines are exposed. Exposure of Alloy 718 to such temperatures will, with time, lead to microstructural instability due to the Alloy 718 not being thermally stable at these temperatures, leading to a reduction in the mechanical strength of the alloy. The higher the temperature the faster a loss in strength will occur. Thermal instability starts occurring at a temperature around 675° C., at which temperature microstructural changes occur relatively slowly such that it can withstand exposure to this temperature for on the order of magnitude some 1000 hours, while above 760° C. the microstructural changes occur rapidly leading to a critical decrease in strength within a few hours.

As discussed above, components might be formed by a combination of different alloys depending on, e.g., the different temperature requirements in different parts of the component. According to one embodiment, described in detail below, components can be formed by an Alloy 282 combined with an Alloy 718. Other combinations might be of Alloy 282 with Alloy 718Plus or Alloy282 with C263. One area of application is in components for aircraft engines, such as turbine exhaust cases.

Figure 3A:
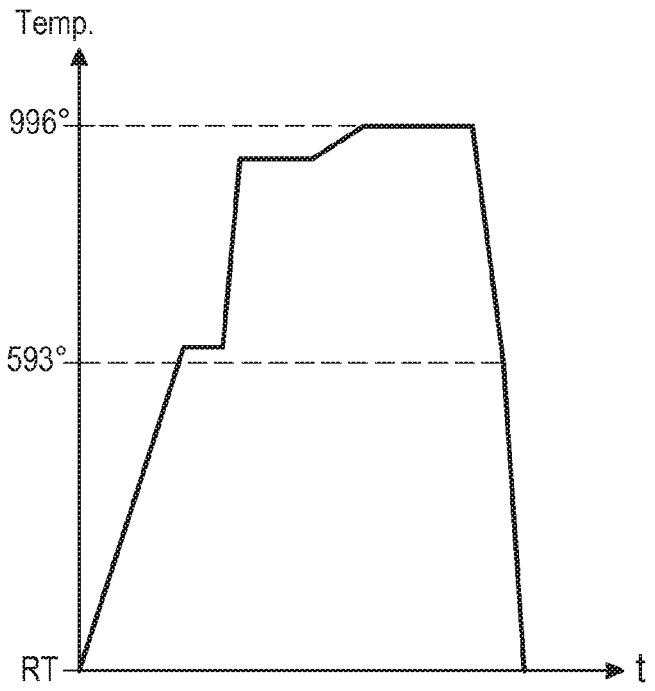
FIGS. 3A and 3B schematically show temperature/time diagrams depicting a method for heat treatment of an alloy 282 in combination with an alloy 718.
Figure 3B:
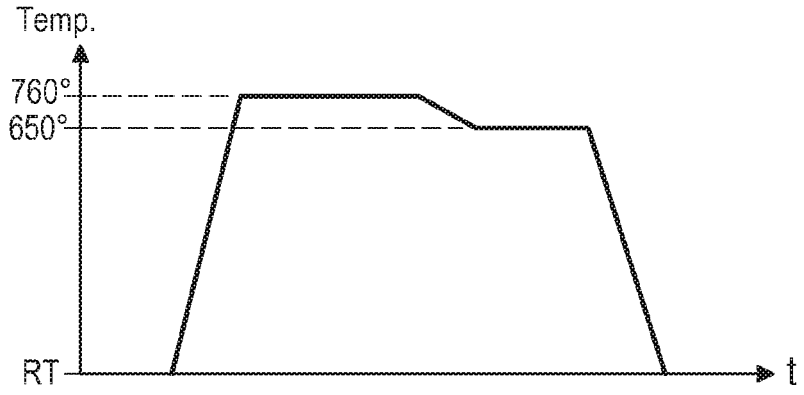

The method for heat treatment of a component comprising Alloy 282 and Alloy 718 according to a preferred embodiment is illustrated in FIGS. 3A and 3B.

FIG. 3A illustrates the part of the heat treatment referred to as solution treatment aimed at dissolving gamma-prime and allow the optimum re-precipitation at the aging step that follows. Also, residual stresses in the material which might have been caused by previous mechanical treatments or stresses from welding can be relaxed.

As illustrated in FIG. 3A, the component is heated at the solution treatment temperature in the range 954-1010° C. (1750-1850° F.) and is kept at this temperature until the gamma prime (γ') is sufficiently dissolved. In addition, the material is relieved from possible internal stress caused by manufacturing processes. The term sufficiently dissolved is to be understood in relation to the resulting tensile strength and yield strength of the material after a completed heat treatment. It is to be understood, that after completing a heat treatment as described here within with respect to FIG. 3A and FIG. 3B, the mechanical strength properties as shown in Table 1 and Table 2 below should be reached. Typically, the alloy 282 should be heated at the specified temperature for a time ranging approximately from 0.5 hours to 2 hours. The exact time will depend on the temperature. Solution annealing at a high end of the temperature interval will require a shorter time in order to achieve a sufficient dissolution of the gamma prime phase. In FIG. 3A, a solution treatment temperature of 996° C. according to a preferred embodiment is indicated. Subsequently, it is cooled to a sufficiently low temperature, and at a sufficiently high cooling rate, to suppress gamma prime precipitation. For example, it can be cooled to at least 593° C. (1100° F.) by rapid cooling. A high cooling rate is advantageous since it can improve the strength of the alloy material. However, the maximum cooling rate that can be used will depend on the application, i.e., on the piece of material or the component that is treated. When cooling a component formed by one or more alloys, cooling should be performed at a rate of e.g., 19-25° C./min (35-45° F./min). If cooling a component faster than the preferred 19-25° C./min care has to be taken to avoid problems with cracking and deformation of the component. Eventually, it could be cooled down to room temperature.

As indicated schematically in FIG. 3A, during heating of the component from a starting temperature, e.g., room temperature, to the solution annealing temperature takes place stepwise. The temperature increase is usually stopped at one or more levels, the so called temperature equalization levels where the furnace temperature is kept constant such that the temperature in the component is allowed to equalize. Such a temperature equalization level is illustrated by the first flat plateau in FIG. 3A. The age hardening temperature region of the alloys comprised in the component must be passed through as quickly as possible, in order to prevent premature hardening of the material. This is illustrated by the straight art of the curve of FIG. 3A. The component might subsequently be allowed to temperature equalize at a temperature above the age hardening temperature region, but below the solution annealing temperature, before finally increasing the temperature to the desired solution annealing temperature.

The solution treatment, as disclosed in FIG. 3A, may be separated from the part of the heat treatment disclosed in FIG. 3B, which is referred to as age-hardening, or the age-hardening might be performed directly after the solution treatment. The age-hardening process influences the resulting strength of the alloys.

FIG. 3B illustrates the age-hardening part of the heat treatment according to the present embodiment. Here, the component is heated to 760° C. (1400° F.) and held at that temperature for 5 hours. Subsequently, it is cooled at an average rate of 56° C.±8° C. per hour (100° F.±15° F.) to a temperature of 650° C. (1200° F.), where it is held for 1 hour. Subsequently it is cooled to room temperature. This cooling can take place at any rate, but in practice a component is cooled at a rate equivalent to air cool or faster.

Although the heat treatment according to a preferred embodiment as described with reference to FIGS. 3A and 3B is developed to provide a heat treatment method for components comprising both portions made of Alloy 282 as well as portions made of Alloy 718, where the whole component is subjected to the heat treatment, the disclosed method can of course also be used for any of these alloys individually. Particularly surprising, it can be used for heat treatment of Alloy 282 while still achieving the advantageous technical characteristics known for this alloy. It can be used for heat treatment of Alloy 718.

Conventional heat treatment methods for Alloy 718, as also specified by the standards AMS 5596, AMS 5662 and AMS 5383, are described below. For the Alloy 718, the solution treatment should be performed at a temperature of at least 915° C., more preferably at least 927° C., in order to dissolve the gamma double prime phase so that the material after cooling can be effectively hardened, and to control the delta phase which can limit grain growth. For Alloy 718 this step is, e.g., performed at 954° C. in order to optimize the mechanical properties of the alloy. Higher temperatures might lead to grain growth resulting in lower strength. The delta phase, which controls grain growth, is dissolved at approximately 980-1010° C. for Alloy 718, depending on the specific type of Alloy 718 and its thermo mechanical processing history. The solution treatment step of Alloy 718 should therefore, according to prejudices in the art, be performed below this temperature.

The conventional heat treatment method for Alloy 282 is specified e.g. in the standard AMS 5951. The main strengthening phase for Alloy 282 is the gamma prime phase, which corresponds to the gamma double prime phase in Alloy 718. The gamma prime phase starts being influenced at a temperature around 940° C. The gamma prime solvus temperature of Alloy 282 is approximately 995° C. Therefore, for Alloy 282, the solution treatment step should, according to the prejudice in the art, be performed at a temperature above 995° C., e.g., at 1010° C., in order to ensure that the subsequent age-hardening step occurs effectively.

According to the method as disclosed here within, the solution treatment step is performed at a temperature within the range 954-1010° C. Preferably, it is performed at a temperature of 996° C. (1825° F.), in order to reach a balance between the preferred solution heat treatment temperatures for Alloy 282 and Alloy 718. In this way, the heat treatment is also adapted to optimize the resulting mechanical properties of a component comprising both Alloy 282 and Alloy 718 which are subjected to a common heat treatment after being worked together. In this way, the desired strength for the Alloy 282 can be ensured, while a detrimental effect on the strength of the Alloy 718 due to this somewhat elevated temperature is limited. The resulting strength of the Alloy 718 component is mainly depending on the rate of cooling from the solution temperature and on the age-hardening step, shown in FIG. 3B.

It is noted that the mentioned temperature values and time indications are subject to certain tolerances. According to these tolerances, time values are given with an accuracy of ±10 minutes, and temperature values are given with an accuracy of ±14 degrees, due to the accuracy of the furnace. The holding time indicated for the different temperatures in the heat treatment method relates to the time period during which the whole component is at the prescribed temperature. The total time that a component is kept at a certain temperature will therefore depend on the size of the component.

In Tables 1 and 2, comparisons are shown for mechanical strength values obtained for Haynes 282 alloy heat treated according to the conventional method known in the art and for Haynes 282 heat treated with the method as described here within.

TABLE 1

Mechanical strength properties of Haynes 282 as sheet.

| | Haynes 282 heat treated with conventional method | | Haynes 282 heat treated with method according to preferred embodiment | |
|---|---|---|---|---|
| | RT | 650° C. | RT | 650° C. |
| UTS (MPa) | 1132 | 1010 | 1237 | 1086 |
| YS (MPa) | 699 | 631 | 796 | 704 |
| EL (%) | 30 | 27.5 | 32.5 | 35 |

RT: room temperature
UTS: Ultimate tensile strength
YS: Yield strength
EL: elongation

TABLE 2

Mechanical strength properties of Haynes 282 forging.

| | Haynes 282 heat treated with conventional method RT | Haynes 282 heat treated with method according to preferred embodiment RT |
|---|---|---|
| UTS (MPa) | 1158 | 1196 |
| YS (MPa) | 700 | 737 |

RT: room temperature
UTS: Ultimate tensile strength
YS: Yield strength
EL: elongation As can be seen from Table 1 and Table 2 the ultimate tensile strength and the yield strength of Haynes 282 after treatment with the method as described here within are improved as compared to corresponding characteristics for Haynes 282 heat treated according to the conventional method for Haynes 282.

Correspondingly, the ultimate tensile strength and the yield strength characteristics of Alloy 718 are only negligibly decreased by the use of an increased solution annealing temperature as compared to the conventional heat treatment method for Alloy 718.

A special advantage of the heat treatment method as described above with reference to FIGS. 3A and 3B is that it can be applied to components comprising portions of Alloy 282 combined with portions of Alloy 718, since it gives rise to a component where the respective properties of the two different alloys in combination are optimized. The heat treatment method can be applied to components where Alloy 282 has been joined to Alloy 718 by welding, or by any other suitable method, e.g., by using fasteners such as bolts or screws, or by clamping. Alternatively, the two alloys can be joined together by brazing during the heat treatment. Prior to welding or brazing, the different portions can be shaped into a desired form, e.g. by being wrought, cast, spray formed, or by using powder metallurgy methods or free forming methods using power beams (Electron, Tungsten Inert Gas (TIG), Laser, etc.) where the material is added in the form of wire, or powder and in which small volumes of melted material is gradually deposited to form free standing structures or shapes. Free forming methods further allow portions of different materials to be formed on top of each other. Thereby, components comprising multiple alloys can be manufactured by first forming a portion of Alloy 718 and subsequently forming a portion of Alloy 282 onto the portion of Alloy 718. Alternatively, a portion of Alloy 718 could be free formed onto a portion of Alloy 282. According to the method presented here within, the component is subjected to the heat treatment after the two portions have been joined together, whereby the two portions are subjected to a common heat treatment. The free forming methods as described herein can also be referred to as metal deposition or additive manufacturing.

The heat treatment as described herein can be applied to a turbine exhaust case comprising multiple alloys prior to mounting within the engine. The finished turbine exhaust case, after being formed by joining portions of Alloy 282 with portions of Alloy 718 in desired portions is subjected to the heat treatment according to the method as described with reference to FIGS. 3A and 3B. Thereby a turbine exhaust case is achieved which can operate at the extreme temperatures required while at the same time fulfilling requirements regarding performance, weight, cost and environmental aspects.

Figure 2:
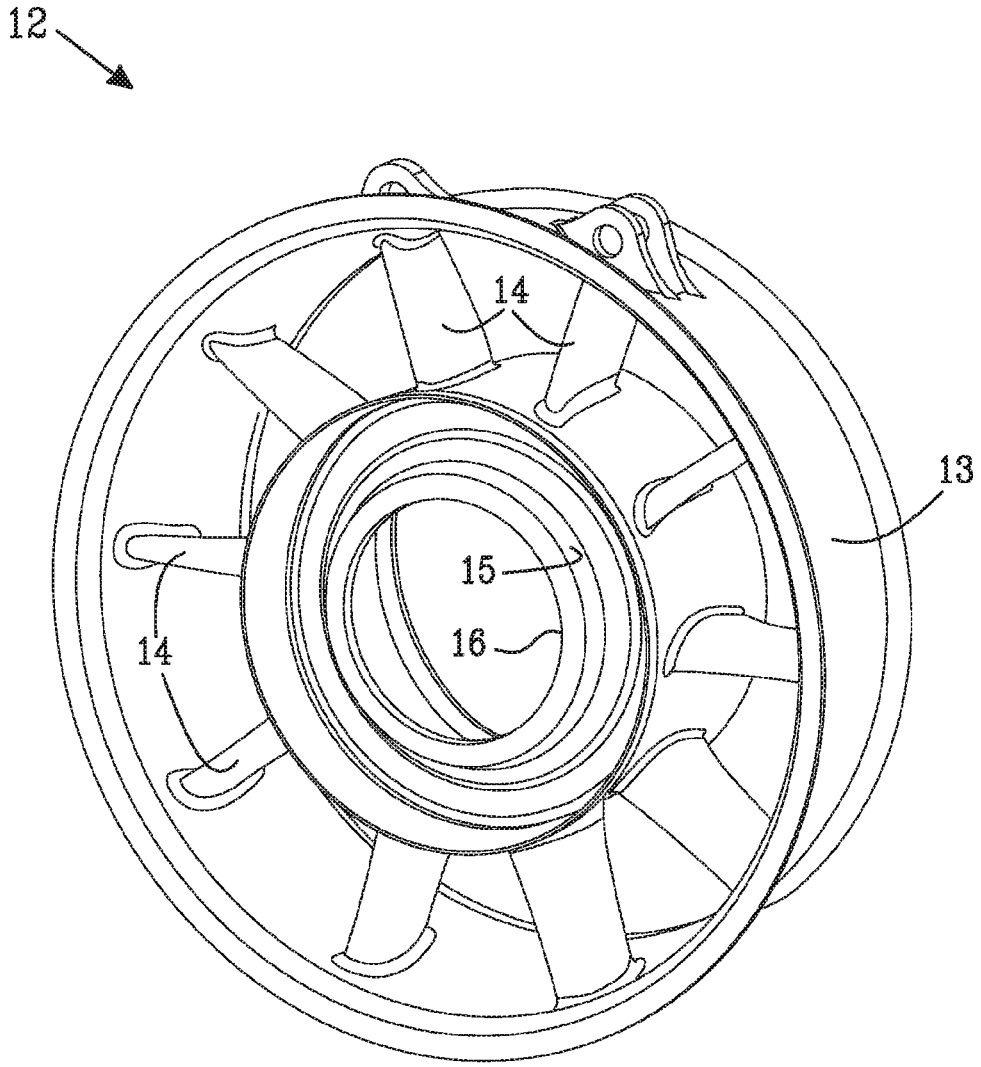
FIG. 2 schematically shows a turbine exhaust case (TEC)

The method described herein is not limited to components for the type of aircraft engine illustrated in FIG. 1 which e.g., is provided with a turbine exhaust case of FIG. 2, but can be used for applications also in other types of aircraft engines. Further, it is not limited to the field of aircraft engines, but can be used also for fabrication of components to be used in other turbo machines, turbine engines, land based gas turbines, automotive or marine application, i.e., any type of application requiring high strength alloys for use at high temperatures, especially where a component must be formed from two or more different types of alloys. Such a multi-alloy component can then be subjected to the heat treatment as set out above.

Further modifications of the heat treatment method and products and components resulting from application of the heat treatment method to various alloys within the scope of the claims will be apparent to the skilled person.

The invention claimed is:

1. A method for heat treatment of an Alloy 282 which has been subjected to an initial solution annealing followed by cooling, where the Alloy 282 is joined together with an Alloy 718 prior to the heat treatment, the method comprising:

a) heating the joined Alloys 282 and 718 at a temperature between 954° C. and 1010° C., ±14° C., and b) cooling the joined Alloys 282 and 718 to a temperature below 594° C., and at a cooling rate equal to or higher than 19° C./min;

c) heating the joined Alloys 282 and 718 at 760° C.±14° C. for 5 hours±10 minutes followed by cooling to 650° C.±14° C., and d) holding the joined Alloys 282 and 718 at 650° C.±14° C. for 1 hour±10 minutes.

2. The method for heat treatment of an Alloy 282 according to claim 1, wherein in step a) the joined Alloys 282 and 718 are heated for a time of 0.5 to 2 hours, ±10 minutes.

3. The method for heat treatment of an Alloy 282 according to claim 1, wherein the cooling in step b) is performed at a rate of 19-25° C./min.

4. The method for heat treatment of an Alloy 282 according to claim 1, wherein the heating as defined by step a) is performed at 954° C.

5. The method for heat treatment of an Alloy 282 according to claim 1, wherein cooling from 760° C. to 650° C. is performed at an average rate of 56° C.±8° C. per hour.

6. The method according to claim 1, where the Alloy 282 and the Alloy 718 have been joined together by welding or by a free-forming method.

7. The method according to claim 1, wherein the Alloy 282 has been formed into a shape by any of being wrought, cast, spray formed, formed by powder metallurgy, or formed by a free-forming method.

8. The method according to claim 1, wherein the Alloy 282 or the Alloy 718 or both have been formed into a shape by any of being wrought, cast, spray formed, formed by powder metallurgy, or formed by a free-forming method.

* * * * *